US005282919A

United States Patent [19]

Brooks

[11] Patent Number: 5,282,919

[45] Date of Patent: Feb. 1, 1994

[54] APPARATUS FOR REMOVING A MARKING FROM A SURFACE

[75] Inventor: Lamar E. Brooks, Wellesley, Mass.

[73] Assignee: The Gillette Company, Boston, Mass.

[21] Appl. No.: 586,432

[22] Filed: Sep. 21, 1990

Related U.S. Application Data

[62] Division of Ser. No. 205,878, Jun. 13, 1988, Pat. No. 4,968,371.

[51] Int. Cl.[5] ..... B32B 31/24

[52] U.S. Cl. ..... 156/379.6; 156/380.9; 156/538; 156/579; 156/584; 219/553

[58] Field of Search ..... 156/584, 379.6, 380.9, 156/538, 579, 272.2, 235; 400/700; 219/552, 553; 310/339; 353/43, 119, 120; 352/33, 129

[56] References Cited

U.S. PATENT DOCUMENTS

| | | | |
|---|---|---|---|
| 2,236,754 | 4/1941 | Gurwick | 101/416 |
| 2,276,387 | 3/1942 | Gurwick | 93/3 |
| 2,410,361 | 10/1946 | Prance | 18/47.5 |
| 2,486,259 | 10/1949 | Chavannes | 101/211 |
| 2,503,758 | 4/1950 | Murray | 117/37 |
| 2,503,759 | 4/1950 | Murray | 117/37 |
| 2,532,941 | 12/1950 | Rado | 154/99 |
| 2,552,209 | 5/1951 | Murray | 101/426 |
| 2,553,100 | 5/1951 | Lynch | 353/43 X |
| 2,591,519 | 4/1952 | Decker | 352/129 X |
| 2,594,290 | 4/1952 | Chavannes | 154/97.5 |
| 2,632,921 | 3/1953 | Kreidl | 18/47.5 |
| 2,721,821 | 10/1955 | Hoover | 156/272.2 X |
| 3,362,771 | 1/1968 | Rodda | 352/33 X |
| 3,401,596 | 9/1968 | Hirsch | 353/43 |
| 3,553,421 | 1/1971 | Schawlow | 219/121 |
| 3,924,728 | 12/1975 | Brown et al. | 197/172 |
| 4,085,838 | 4/1978 | Pierce | 197/181 |
| 4,110,597 | 8/1978 | Elmore | 219/200 |
| 4,595,864 | 6/1986 | Stiefelmeyer | 315/70 |
| 4,786,195 | 11/1988 | Hibino et al. | 400/696 |
| 4,857,887 | 8/1989 | Iten | 310/339 X |

FOREIGN PATENT DOCUMENTS

| | | | |
|---|---|---|---|
| 64-20191 | 1/1989 | Japan | 156/235 |
| 622976 | 7/1949 | United Kingdom . | |

OTHER PUBLICATIONS

Wake, W. C., *Adhesion & the Formulation of Adhesives*, 2nd ed., 1982, pp. 270–271.

*CRC Handbook of Chemistry & Physics*, 59th ed., 1978, p. E-212.

*Primary Examiner*—David A. Simmons
*Assistant Examiner*—Chester T. Barry
*Attorney, Agent, or Firm*—Owen J. Meegan; Aubrey C. Brine; Donal B. Tobin

[57] ABSTRACT

Apparatus for removing a marking from a stratum surface comprises a pellucid film in the form of a heat softenable polymeric material to be placed over a marking and a source of light energy for irradiating the marking and film to heat the marking and soften the polymeric material to thereby transfer the marking to the film. The apparatus in the form of a pen type implement provides means for energizing the light source and thereafter moving the pellucid film in single operation.

16 Claims, 3 Drawing Sheets

APPARATUS FOR REMOVING A MARKING FROM A SURFACE

This is a divisional of co-pending application, Ser. No. 07/205,878 filed on Jun. 13, 1988 now U.S. Pat. No. 4,968,371.

BACKGROUND OF THE INVENTION

1. Field of the Invention

This invention basically relates to novel, improved methods and apparatus for removing a marking from a stratum surface. Additionally, this invention relates to novel, improved methods and apparatus for correcting a marking on a surface by removing the marking and replacing it with another marking.

2. Description of the Prior Art

The correction of markings such as written, typewritten or photodeposited markings on paper surfaces is well known in the art. Essentially, such corrections involve either initially removing the marking with an eraser or masking the marking with a correction fluid and replacing the removed or masked marking with another marking. Ideally, removal of the marking would represent the best approach for making such corrections. However, known erasers are notoriously ineffective for removing markings produced by pens, typewriters or photodeposition apparatus. Such markings are extremely resistant to removal by erasers and are not satisfactorily removed unless excessive abrading force is used which adversely affects the quality of the substrate surface.

Correction fluids have been used extensively in the art as a preferred, more effective way to correct markings because of the shortcomings of erasers. Such correction fluids include an opacifying agent dispersed in a liquid which usually includes a soluble film-forming material. In use, the fluids are applied to the marking, allowed to dry, and a new marking is applied to the dried, coalesced residue of the fluid. Some disadvantages of correction fluids include the time required to apply and dry the fluid and incomplete masking of the marking usually because of "bleeding" resulting from interaction between the marking and the ingredients of the fluids which usually include an organic solvent. Another disadvantage is that the corrected marking is oftentimes detectable unless the coalesced residue of the fluid closely corresponds in texture and color of the substrate surface. Accordingly, there is an outstanding need in the art for a method which can quickly and effectively remove a marking from a surface without encountering the inconveniences involved in abrading or masking the marking. This invention is addressed to that need and provides effective response to that need.

SUMMARY OF THE INVENTION

The invention presents to the art novel, improved methods for removing a marking such as a written, typewritten or photodeposited marking from a stratum surface. Removal of the marking is achieved by arranging a pellucid heat-conductive film which includes or carries a heat softenable polymeric material with the marking so that the polymeric material is in contact with the marking. The polymeric material and marking are then irradiated with sufficient radiant visible light energy to heat the marking and the polymeric material to modify the surface energies of the marking and polymeric material so that the marking preferentially adheres to the polymeric material rather than to the stratum surface. Accordingly, the marking is transferred to the film which is then lifted from the stratum surface.

Effective removal of the marking is considered to be primarily a result of the differentials existing between the light-absorbing characteristics (or reflection coefficients) of the marking and the stratum surface surrounding the marking. For example, the reflection coefficient of ordinary white paper to the visible spectrum is on the order of about 80 percent, and therefore, the absorption coefficient is about 20 percent. On the other hand, the absorption coefficient of typewriter ink is about 99 percent. Accordingly, during the brief period of irradiation, the lighter colored surface adjacent the marking reflects the radiant light energy thereby generating relatively little heat. However, the darker marking absorbs the light energy and converts it to heat to thereby heat the marking and the polymeric material in contact with the marking and transfer the marking to the polymeric material. Accordingly, after irradiation, the heated marking and polymeric material cool and remain in contact with each other, and the polymeric material and transferred marking are lifted from the stratum surface. I presently believe that the transfer of the marking to the polymeric material involves changes in the surface energies of the marking and superposed material generated by the conversion of light to heat which causes softening of the marking and/or material and probably changes at least a portion of the meniscus of the marking. However, my belief is presented only as a proposed explanation of the transfer mechanism.

DESCRIPTION OF THE PREFERRED EMBODIMENTS

Figure 1:
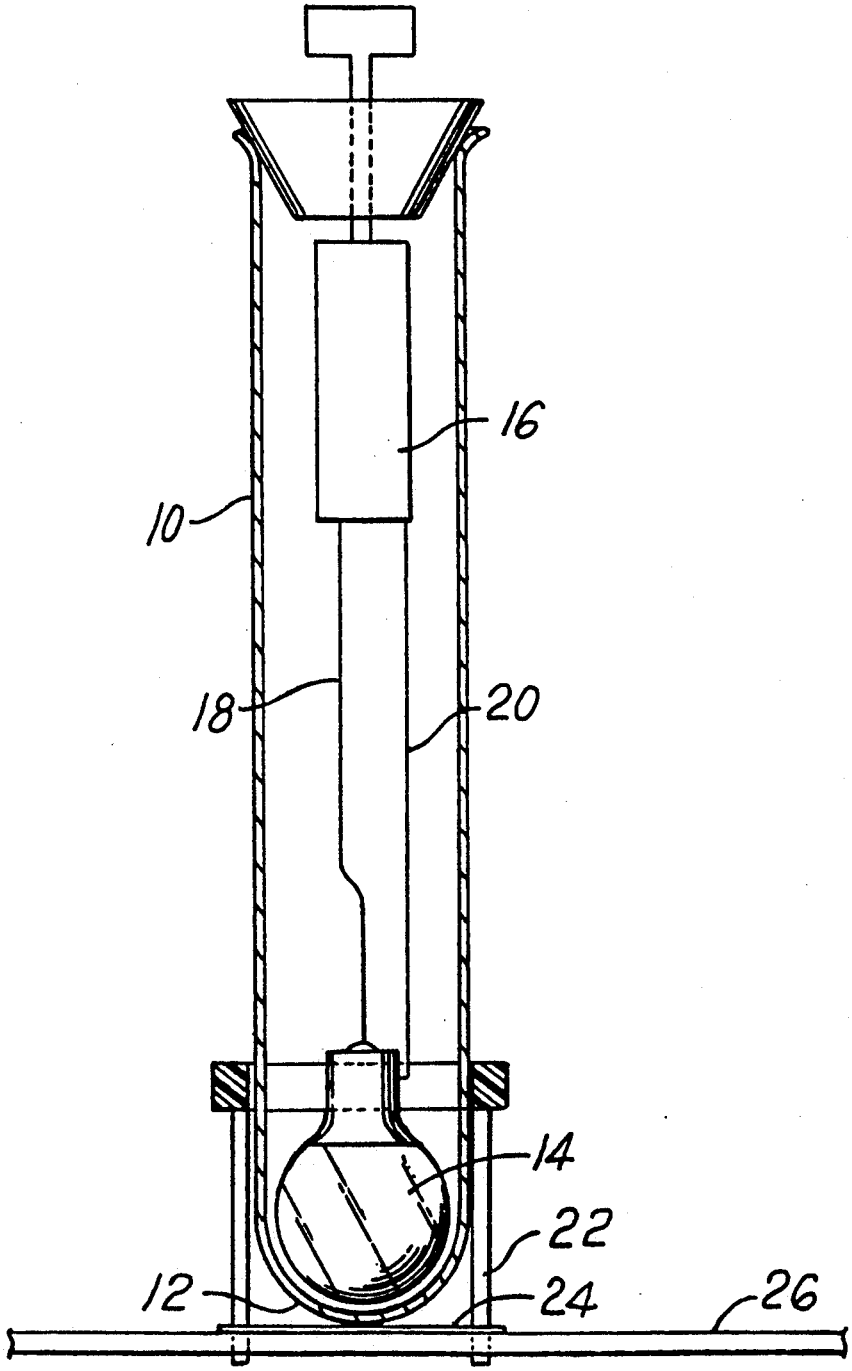
FIG. 1 is a diagrammatic, cross-sectional view of apparatus suitable for use in the practice of the invention.

In the first step of the method of the present invention, a pellucid film, which includes or carries a heat-softenable polymeric material, is arranged in contact with a marking so that the marking and polymeric material are in contact with each other. For the purposes of this invention, a "pellucid film" means a film (or a plurality of films) which can transmit light and can be transparent or translucent although transparent films are preferred. Heat-softenable polymeric materials suitable in the practice of the invention are heat-activatable (hot melt) adhesives having a melt index between about 3 to about 150 and preferably having a melt index between about 5 to 50. Especially preferred polymeric materials are heat-softenable ethylene-vinylacetate and vinylacetate vinylchloride copolymers especially such copolymers containing from about 5 to about 30 percent by weight vinylacetate. Other suitable heat-softenable polymeric material may be included in the film, or the film may carry the polymeric material. For example, a MYLAR film material or other pellucid substrate film material coated with a thin layer of a heat-softenable polymeric material my be suitably employed in the practice of the invention.

In the second step of the method of the invention, the marking is irradiated through the superposed film so that the absorbed radiation will heat the marking and contiguous portions of the film to a temperature at which the marking will adhere more to the film than to the stratum surface. The temperature, $U_c$, which is needed for transfer of the marking, may be at or near the melting temperature of the marking. As a practical matter, $U_c$ must equal the highest temperature required to transfer a variety a markings from various stratum surfaces to a given polymeric film material. For infinitely long durations of irradiation, the final temperature of the film, $U_{ss}$, is linearly related to the radiant intensity by the thermal characteristics of the polymeric material and to a lesser degree by the thermal characteristics of the stratum surface. Accordingly, there is a minimum intensity input needed to cause the final temperature, $U_{ss}$, to reach the critical temperature $U_c$, and any lower intensity will be ineffective.

In terms of duration, the temperature of the superposed film and marking can be quantified by summing an infinite series of exponential functions of time. For all practical purposes, the final temperature $U_{ss}$ can be considered to be achieved when the slowest of these individual exponential functions reaches about 95 percent of the final value of $U_{ss}$. That is, the film may be considered a temperature gradient resulting from heat transfer from the marking. At the time interval of 10 percent of the final value of $U_{ss}$, the superposed film exhibits a high temperature on one side and about ambient temperature at the center, progressing by heat transfer to a steady state. The time required to reach the final practical value is defined a Tpfv (time for practical final value). Intensities which produce temperatures greater than $U_c$ at a steady state basis may not reach $U_c$ when the duration is less than Tpfv. Conversely, when the intensity is too high, and/or the duration is longer than needed to reach $U_c$, the temperature may be so high as to char or discolor the stratum surface or to volatilizes the marking and spread the marking on or into the stratum surface.

The selection of a visible light source providing an effective duration/intensity combination can be determined empirically without excessive difficulty. Moreover, classical analysis calculations can be used to provide reliable approximate maximum duration and minimum intensity limits needed to remove markings in accordance with the practice of the present invention. The standard text for such calculations is *Conduction of Heat in Solids,* Carslaw and Jaeger, Second Edition, Oxford Clarendon Press, 1959, which is the source for the calculations discussed herein. Essentially, the calculations involve finding two values. The first value is the time (duration) required for the polymeric film covering the marking to reach thermal equilibrium when power is applied constantly to one side. The second value is the power (intensity) needed to adequately heat the marking. These calculations will vary depending upon the thickness and/or conductivity of the polymeric film material. The minimum duration and maximum intensity limits are dictated primarily by practical considerations. For example, extremely short durations require extremely large and usually impractical, unnecessary intensities and vise-versa. Visible light sources capable of providing the desired combinations of intensity and duration of irradiation for the practice of the invention include commercially available flashbulbs, high intensity strobe lights, and laser beam sources, among others.

The essential elements of apparatus for removing markings in accordance with the practice of the present invention include means to superpose a polymeric film on the marking and means to irradiate the film and marking with visible light energy. FIG. 1 illustrates the elements of the apparatus in a rudimentary form. As shown, the apparatus includes a body 10 (a test tube) having a lower surface portion 12 which is light transmissive. Also arranged in body 10 is a visible light source 14 (a flashbulb) which is arranged in communication with surface 12. An activatable source of electrical current 16 is operationally connected to the light source 14 by wires 18 and 20. In FIG. 1, electrical current source 16 is shown as a piezoelectric generator. Frame 22 is fixedly attached to body 10 and provides means to retain polymeric film 24 in close communication with surface 12 and surface 26 carrying a marking selected for removal.

In operation, polymeric film 24 retained by frame 22 is superposed on a selected marking carried on surface 26, usually a paper surface. Light source 14 is then activated by connecting current source 16 to light source 14 to thereby heat the marking and transfer the melted marking to superposed film 24 which is then lifted from surface 26. If desired, a new marking may be applied to the surface to replace the removed marking. Additional details of the invention will be more fully appreciated by reference to the following Example 1, which presents an illustrative, non-limiting embodiment of the invention.

EXAMPLE 1

A 3 mil MYLAR film material carrying a 2 mil coating of an ethylene-vinylacetate having a melt index of about 43 and containing about 28 percent by weight vinylacetate was superposed on a conventional typewritten marking on a paper sheet. The coating was arranged in contact with the marking. A flashbulb sold by General Electric under the tradename GE-M3 was connected to a piezoelectric power source and placed in the bottom of a one-inch diameter glass laboratory test tube. The bottom of the test tube was positioned directly above the film and marking, and the tube was held in contact with the film by light hand pressure. The flashbulb was fired, and thereafter the film with the transferred marking was lifted from the paper surface. Substantially complete removal of the marking from the surface was achieved, and no marking residue or discoloration was observed in the area of the surface from which the marking was removed.

In the above example, the output intensity of the GE-M3 flashbulb was about 16,000 lumen sec. for a duration of about 17.5 milliseconds. Assuming the intensity is an average figure, power would be about 914,806 lumens so that the power of the flashbulb is about 1338 watts (1 lumen equals 1/683 watt). The normal line spacing for typewritten markings is one-sixth of an inch, and the area of a circle having a one-sixth diameter is 0.0218 square inch. Assuming that the power was radiated equally over all of the surface of the one-inch diameter test tube holding the flashbulb, the power would be distributed over 0.785 square inches. The ratio of the area of the circle containing the marking to the total area over which the power was distributed was 0.028. Accordingly, the marking within the circle in the Example was exposed to about 37 watts.

As mentioned before, calculations based on classical analysis can provide reliable approximate maximum duration and minimum intensity limits needed to remove markings in accordance with the practice of the invention. Calculations for the duration needed to heat a 5 mil thick polyester film to a thermal equilibrium temperature of 150° C. above ambient establish that the duration need not exceed about 275 ms. Calculations for the intensity needed to raise the 5 mil thick polyester to 150° C. above ambient establish that the required minimum total power per unit area is $4.14\times10^5$ watts/meter$^2$. Since the marking is within the area of a circle having a one-sixth inch diameter (0.0218 square inches or $1.4\times10^{-5}$ meters$^2$), the calculated minimum power needed to melt the marking is 5.8 watts.

A comparison of the calculated maximum duration and minimum intensity values with the actual duration and intensity values of Example 1 provides interesting information relating to alternative useful duration/intensity combinations. Since the duration in Example 1 is much shorter than the calculated time needed to reach tpfv, we can estimate that the marking reached only about 23 percent of the steady temperature which would have been reached at the calculated maximum duration (275 ms). Moreover, the marking of Example 1 was exposed to 37 watts, while the calculated minimum required power is 5.8 watts. Since the duration in Example 1 represents only about 23 percent of the calculated steady state temperature, it would be reasonable to expect that 8.6 watts ($0.23\times37$ watts) together with the calculated maximum duration would provide results equal to those achieved in Example 1.

Referring now to FIGS. 2 through 6, alternate apparatus is shown for performing the procedure as set forth in Example 1 above in which a pen type implement 30 comprises a cylindrical barrel or housing 32 having a closure member 34 threadably received at the upper end thereof and partially open at the bottom. At the lower end of the housing 32, a pair of flanges 36 and 38 extend into the bottom opening at substantially right angles to the internal wall of the housing, and a pair of stop members 39 and 40 of lesser dimension than the flanges are spaced opposite one from the other and extend into the opening, being offset 90° from the flanges.

Figure 2:
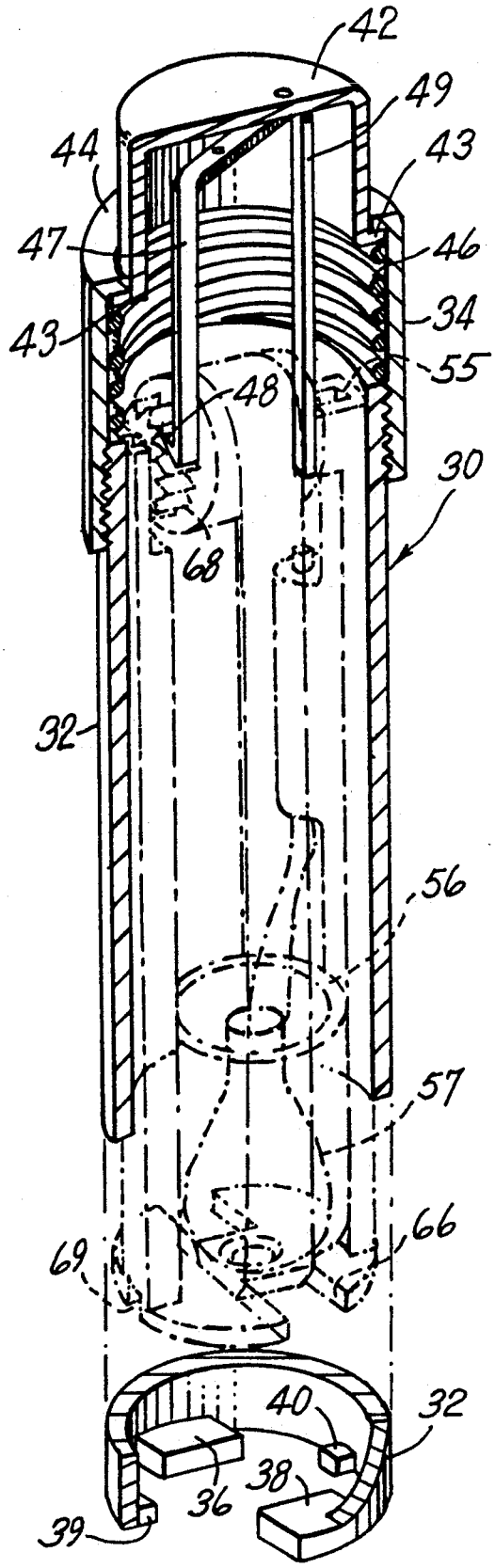
FIG. 2 is a fragmentary elevational view, partially in section showing a pen size implement providing apparatus for removing a marking from a stratum surface in accordance with the teachings of the present invention.
Figure 5:
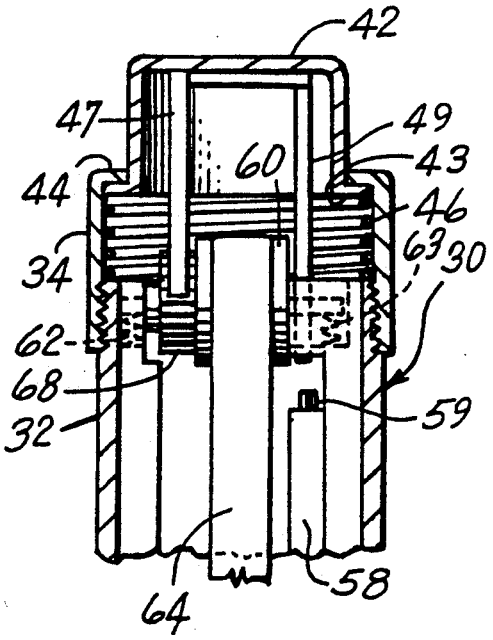
FIG. 5 is a fragmentary sectional view showing details of the upper portion of the structure of FIG. 2.
Figure 6:
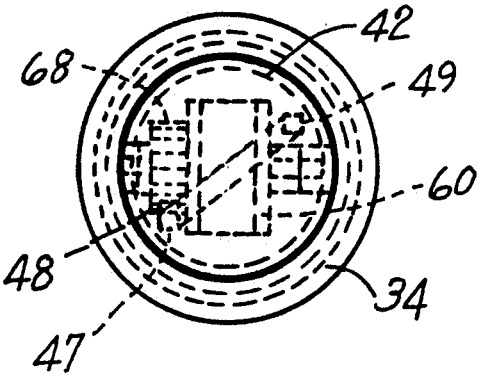
FIG. 6 is a top plan view of the structure of FIG. 5 showing further details, and arrangement, of the structural elements contained in the implement of FIG. 2.

As best shown in FIGS. 2 and 5, a movable cap member 42 having an outwardly extending flange 43 is disposed adjacent the top opening of the housing 32 and is retained by an inwardly projecting flange 44 of the closure member 34. A spring 46 is disposed between the upper rim of the housing 32 and the flange 43 biasing the movable cap member 42 to the position shown in FIG. 2.

Referring still to FIGS. 2 and 5, the movable member 42 has mounted on its inner surface a spring arm 47 having a pawl 48 disposed at the end thereof, and a plunger 49, both the plunger 49 and spring arm 47 extending axially into the housing 32.

Figure 3:
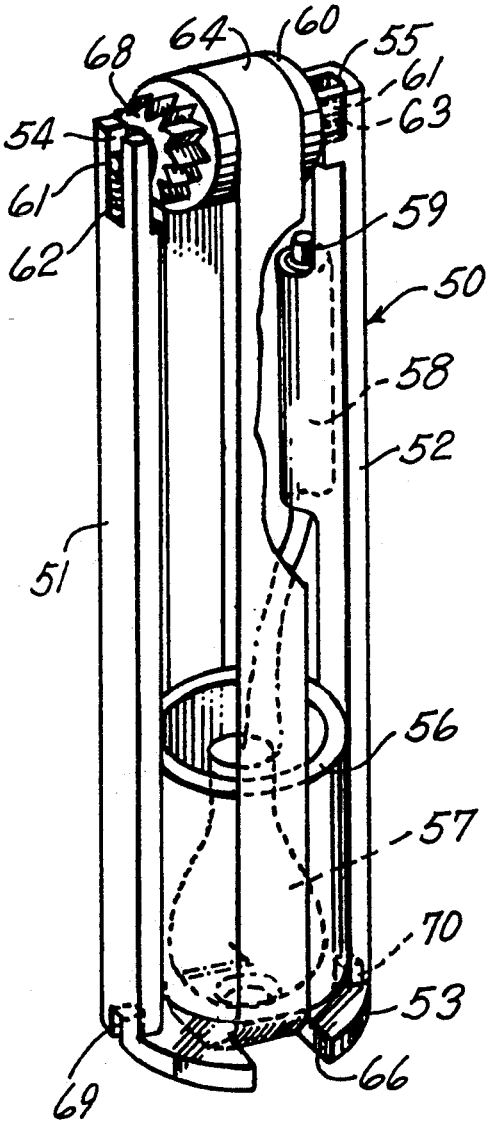
FIG. 3 is a fragmentary elevational view showing an element of the implement of FIG. 2, removed from the implement to show details of construction.
Figure 4:
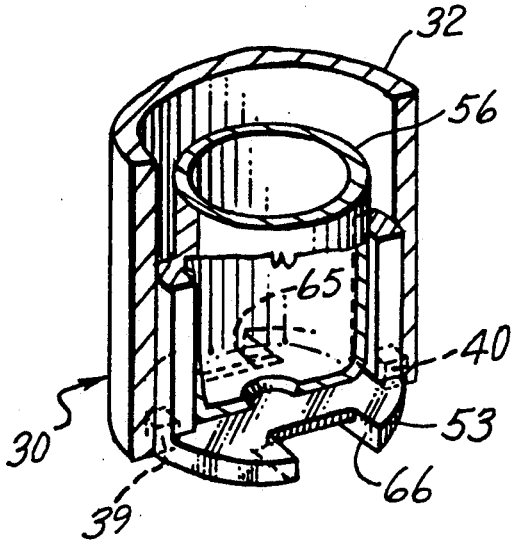
FIG. 4 is a fragmentary sectional view showing details of the lower portion of the structure of FIG. 2.

Referring now to FIG. 3, there is shown a sub-assembly 50 which is received within the housing 32 to form the pen type implement 30. The sub-assembly 50 comprises a pair of support members 51 and 52, the lower ends of which are connected to an acrylic window tape guide 53, each support member having a slotted opening 54 and 55 respectively disposed at the upper end thereof. A cylindrical shield 56 having a circular opening formed at its center rests on the acrylic window tape guide 53 and is dimensioned to be held in close fitting engagement between the support members 51 and 52. A flashbulb 57 is disposed within the shield 56, which may be similar to the flashbulb previously described with regard to the structure of FIG. 1. The flashbulb 57 is interconnected by a pair of wires to a piezoelectric generator 58 which is mounted on the support member 52 and is actuated by a button 59 disposed at the top of the generator.

At the upper end of the sub-assembly 50, a tape cylinder 60 is mounted having its axle 61 extending into the slotted openings 54 and 55. The axle 61 of the cylinder 60 rests on a pair of springs 62 and 63 which bias the cylinder 60 upwardly away from the bottom of the sub-assembly 50. A continuous tape 64 of the type described in Example 1 above extends over the bottom surface of the acrylic window and is received in a pair of slots 65 and 66 formed in the window. The tape is threaded over the tape cylinder 60 forcing the springs 62 and 63 to compress downwardly, and therefore maintaining the tape in contact with the lower surface of the acrylic window tape guide 52. A ratchet 68 is mounted at one side of the tape cylinder 60 and attached to the axle 61 such that movement of the ratchet wheel 68 causes movement of the drum 60 and the tape 64.

To assemble the implement 30, the closure member 34 is removed from the housing 32, as is the movable cap member 42, and the sub-assembly 50 is inserted through the top opening of the housing 32, the slots 65 and 66 receiving the flanges 36 and 38 in interfitting engagement and the stop members 39 and 40 being received in a pair of slotted openings 69 and 70 formed in the sub-assembly. The flanges 36 and 38 in combination with the acrylic window tape guide 53 form the bottom surface of the implement 30, the tape 64 being fed over the provided surface. The cap member 42 and the closure member 34 are now placed on the implement 30 and the closure member is screwed onto the housing 32 with the pawl 38 positioned in contact with the ratchet wheel 68 and the plunger 49 positioned in contact with the button 59 on the piezoelectric generator 58.

In operation, when it is desired to remove a marking from a stratum surface, the implement 30 is placed such that the lower surface is located over the marking with the tape 64 in contact with the marking. The movable cap member 42 is moved downwardly forcing the plunger onto the button 59 and discharging the piezoelectric generator 58 through the flashbulb 57 to remove the marking as described in detail in Example 1. The Spring arm 47 is flexible to allow the pawl 48 to move downwardly over the teeth of the ratchet wheel 68 during downward movement of the cap member 42. However, on release of the cap member 42, the spring 46 forces the cap upwardly and the pawl 48 contacts a tooth of the ratchet wheel 68 rotating the tape cylinder 60 and moving the tape 64 to present a new portion of tape adjacent the lower surface of the tape guide 53.

When the tape 64 has been completely used, the sub-assembly 50 may be removed from the housing 32 and a new tape installed on the sub-assembly for reuse of the implement 30.

It should be apparent from the above description that the invention presents to the art an extremely fast, relatively simple but highly effective method for removing markings from a stratum surface. Unlike methods known to the art, the invention does not involve abrading of the marking which normally results in incomplete removal of the marking and undesirable alteration of the quality of the surface carrying the marking. Additionally, the application of a masking composition is not involved, and the time required to apply and dry such compositions and other complications are avoided. Accordingly, the invention presents to the art improved, unexpected and desirable advantages over the methods and apparatus known to the art at the time the present invention was made.

What is claimed is:

1. Apparatus for removing a marking from a stratum surface comprising wall structure forming a substantially enclosed housing having a light transmissive wall disposed at one end thereof;

means disposed in said housing to arrange a portion of a pellucid film including a heat softenable polymeric material with one surface in contact with an outer surface of said housing wall and the opposite film surface in contact with a stratum surface; and means disposed adjacent the inner surface of said wall to irradiate the marking through said wall with sufficient light energy to heat the marking and the polymeric material to transfer the melted marking to the polymeric material.

2. Apparatus as set forth in claim 1 wherein said means to irradiate the marking comprises a flashbulb having an output intensity in the area of about 16,000 lumen seconds for a duration of about 17.5 seconds.

3. Apparatus as set forth in claim 1 wherein said means to irradiate the marking comprises a light source connected to a piezoelectric generator.

4. Apparatus as set forth in claim 1 wherein said means to arrange the pellucid film comprises rotatable means for feeding the film over said outer surface of said wall.

5. Apparatus as set forth in claim 4 wherein said means to irradiate the marking comprises a light source, said apparatus further comprising means movable from a first position to a second position to energize said light source and from said second position to said first position to feed the film over said outer surface.

6. Apparatus as set forth in claim 5 wherein said means movable through said first and second positions comprises said movable cap.

7. Apparatus for removing a marking from a stratum surface comprising a housing having a light transmissive wall comprising an outer surface for superposition with a marking carried by a stratum surface;

an elongated tape comprising a pellucid film including or carrying a heat softenable polymeric material, said film contained in said housing having a portion thereof extending over said housing outer surface;

means disposed in said housing to irradiate the marking through said wall with sufficient light energy to heat the marking and the polymeric material to transfer the melted marking to the polymeric material; and means for feeding said elongated tape over said housing wall outer surface.

8. Apparatus for removing a marking from a stratum surface comprising wall structure forming a substantially enclosed housing having a light transmissive wall disposed at one end thereof;

a pellucid film including or carrying a heat softenable polymeric material with one surface in contact with an outer surface of said housing wall;

means to arrange a portion of said pellucid film in super-position with a marking carried by a stratum surface; and means disposed adjacent the inner surface of said wall to irradiate the marking through said wall with sufficient light energy to heat the marking and the polymeric material to thereby transfer the melted marking to the polymeric material.

9. Apparatus as set forth in claim 8 where the polymeric material is dispersed in the film.

10. Apparatus as set forth in claim 8 where the polymeric material is carried by the film as a layer.

11. Apparatus as set forth in claim 8 where the polymeric material is a heat activatable adhesive having a melt index between about 3 to 150.

12. Apparatus as set forth in claim 11 where the polymeric material is polymer or copolymer of vinyl acetate, vinylchloride, vinylidene chloride, vinyl butyral, styrene or mixtures of these.

13. Apparatus as set forth in claim 11 where the polymeric material is a copolymer of ethylene vinylacetate, vinylacetate vinylchloride, or mixture of these.

14. Apparatus as set forth in claim 8 wherein the film is transparent.

15. Apparatus for removing a marking from a stratum surface comprising:

a housing having an elongated barrel with an outer surface disposed at one end and containing means to arrange a pellucid film including or carrying a heat softenable polymeric material with one surface in superposition with a marking carried by a substrate surface; and means to irradiate the marking with sufficient light energy to heat the marking and the polymeric material to thereby transfer the melted marking to the polymeric material, said means to irradiate the marking comprising a light source and said means to arrange said pellucid film comprising means movable from a first position to a second position to energize said light source and from said second position to said first position to feed the film over said housing outer surface.

16. Apparatus as set forth in claim 15 wherein said housing further comprises a movable cap member disposed at the end of said elongated barrel member opposite said housing outer surface and said means movable between a first and second position comprises a movable cap member.

* * * * *